US010018928B2

(12) United States Patent
Murakami et al.

(10) Patent No.: US 10,018,928 B2
(45) Date of Patent: Jul. 10, 2018

(54) ELECTROPHOTOGRAPHIC PHOTOSENSITIVE MEMBER, METHOD OF PRODUCING ELECTROPHOTOGRAPHIC PHOTOSENSITIVE MEMBER, AND PROCESS CARTRIDGE AND ELECTROPHOTOGRAPHIC APPARATUS EACH INCLUDING THE ELECTROPHOTOGRAPHIC PHOTOSENSITIVE MEMBER

(71) Applicant: CANON KABUSHIKI KAISHA, Tokyo (JP)

(72) Inventors: Takeshi Murakami, Numazu (JP); Daisuke Kawaguchi, Toride (JP); Kazumichi Sugiyama, Numazu (JP); Daisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/624,866

(22) Filed: Jun. 16, 2017

(65) Prior Publication Data

US 2017/0363976 A1 Dec. 21, 2017

(30) Foreign Application Priority Data

Jun. 21, 2016 (JP) ..... 2016-122852
Jun. 21, 2016 (JP) ..... 2016-122856

(51) Int. Cl.

| | |
|---|---|
| ***G03G 5/00*** | (2006.01) |
| ***G03G 5/02*** | (2006.01) |
| ***G03G 5/14*** | (2006.01) |
| ***G03G 5/05*** | (2006.01) |
| ***G03G 15/00*** | (2006.01) |

(52) U.S. Cl.

CPC ..... *G03G 5/0217* (2013.01); *G03G 5/0214* (2013.01); *G03G 5/0525* (2013.01); *G03G 5/144* (2013.01); *G03G 15/75* (2013.01)

(58) Field of Classification Search

CPC ..... G03G 5/144

(Continued)

(56) References Cited

U.S. PATENT DOCUMENTS

| | | | |
|---|---|---|---|
| 4,908,329 | A | 3/1990 | Kanai et al. |
| 4,908,330 | A | 3/1990 | Arai et al. |

(Continued)

FOREIGN PATENT DOCUMENTS

| | | |
|---|---|---|
| JP | H07-175252 | 7/1995 |
| JP | H11-174705 | 7/1999 |
| JP | 2006-221094 | 8/2006 |

OTHER PUBLICATIONS

U.S. Appl. No. 15/469,949, Takeshi Murakami, filed Mar. 27, 2017.

*Primary Examiner* — Mark A Chapman
(74) *Attorney, Agent, or Firm* — Fitzpatrick Cella Harper and Scinto

(57) ABSTRACT

Provided is an electrophotographic photosensitive member capable of suppressing a ghost image. The electrophotographic photosensitive member includes, in this order: a support; an intermediate layer containing metal oxide particles; and a photosensitive layer, in which the intermediate layer contains at least one kind of compound X selected from the group consisting of a compound represented by the formula (1) and a compound represented by the formula (2).

(1)

(Continued)

-continued (2)

19 Claims, 3 Drawing Sheets

(58) Field of Classification Search
USPC ..... 430/60, 64, 65
See application file for complete search history.

(56) References Cited

U.S. PATENT DOCUMENTS

| | | | |
|---|---|---|---|
| 5,759,291 | A | 6/1998 | Ichinose et al. |
| 6,562,530 | B2 | 5/2003 | Morikawa et al. |
| 6,806,009 | B2 | 10/2004 | Tanaka et al. |
| 6,815,135 | B2 | 11/2004 | Morikawa et al. |
| 6,835,512 | B2 | 12/2004 | Morikawa et al. |
| 6,913,862 | B2 | 7/2005 | Nakata et al. |
| 6,998,210 | B2 | 2/2006 | Yoshimura et al. |
| 7,022,446 | B2 | 4/2006 | Yoshimura et al. |
| 7,078,140 | B2 | 7/2006 | Yoshimura et al. |
| 8,632,935 | B2 | 1/2014 | Sugiyama et al. |
| 8,765,335 | B2 | 7/2014 | Tanaka et al. |
| 8,974,991 | B2 | 3/2015 | Kawahara et al. |
| 9,068,083 | B2 | 6/2015 | Tanaka et al. |
| 9,158,213 | B2 | 10/2015 | Taniguchi et al. |
| 9,164,406 | B2 | 10/2015 | Nishi et al. |
| 9,170,506 | B2 | 10/2015 | Tanaka et al. |
| 9,170,507 | B2 | 10/2015 | Sugiyama et al. |
| 9,274,496 | B2 | 3/2016 | Miyagawa et al. |
| 9,280,071 | B2 | 3/2016 | Maruyama et al. |
| 9,304,414 | B2 | 4/2016 | Miura et al. |
| 9,405,206 | B2 | 8/2016 | Kawaguchi et al. |
| 9,411,307 | B2 | 8/2016 | Matsuda et al. |
| 9,436,107 | B2 | 9/2016 | Murakami et al. |
| 9,459,542 | B2 | 10/2016 | Tanaka et al. |
| 9,535,347 | B2 | 1/2017 | Watariguchi et al. |
| 9,658,543 | B2 | 5/2017 | Murakami et al. |
| 2014/0212800 | A1 | 7/2014 | Miura et al. |
| 2016/0378002 | A1 | 12/2016 | Tanaka et al. |

ELECTROPHOTOGRAPHIC PHOTOSENSITIVE MEMBER, METHOD OF PRODUCING ELECTROPHOTOGRAPHIC PHOTOSENSITIVE MEMBER, AND PROCESS CARTRIDGE AND ELECTROPHOTOGRAPHIC APPARATUS EACH INCLUDING THE ELECTROPHOTOGRAPHIC PHOTOSENSITIVE MEMBER

BACKGROUND OF THE INVENTION

Field of the Invention

The present invention relates to an electrophotographic photosensitive member, a method of producing an electrophotographic photosensitive member, and a process cartridge and an electrophotographic apparatus each including the electrophotographic photosensitive member.

Description of the Related Art

An electrophotographic photosensitive member including a support, an intermediate layer formed on the support, and a photosensitive layer formed on the intermediate layer, in which the photosensitive layer contains an organic charge generating substance and an organic charge transporting substance, has been used as an electrophotographic photosensitive member to be used in an electrophotographic apparatus. The intermediate layer has a function of blocking charge, and serves to suppress the injection of charge from the support toward the photosensitive layer to suppress the occurrence of an image failure, such as a black spot.

In recent years, a charge generating substance having higher sensitivity has been used in association with demands for improvements in resolution and definition. However, the quantity of charge remaining in the photosensitive layer increases in association with an increase in charge generation quantity due to a rise in sensitivity of the charge generating substance. As a result, there arises a problem in that a ghost is liable to occur. Specifically, a so-called positive ghost phenomenon in which the density of only a portion irradiated with light at the time of a previous rotation increases in an output image, or a so-called negative ghost phenomenon in which the density of only the portion irradiated with light at the time of the previous rotation reduces in the image is liable to occur.

Further improvements in speed and image quality of the electrophotographic apparatus have been required in association with the fact that a laser beam printer has recently been able to output a color image in addition to the foregoing, and hence the electrophotographic photosensitive member is required to have more excellent characteristics. One of the required characteristics is to alleviate the deterioration of an image due to a ghost phenomenon.

A technology involving adding a charge transporting substance to the intermediate layer is available as a technology for the suppression of such remaining of charge. In Japanese Patent Application Laid-Open No. 2006-221094, there is a disclosure of a technology involving incorporating a metal oxide and a compound having an anthraquinone structure into an intermediate layer to suppress the occurrence of a ghost. In addition, in Japanese Patent Application Laid-Open No. H11-174705, there is a disclosure of a technology involving incorporating a compound having an oxadiazole structure into an intermediate layer to suppress a long-term potential fluctuation. Further, in Japanese Patent Application Laid-Open No. H07-175252, there is a disclosure of a technology involving incorporating a compound having a benzoazole structure into an intermediate layer to improve the flow of charge.

SUMMARY OF THE INVENTION

However, it cannot be said that the problem of suppressing the remaining of charge is sufficiently solved by the technology disclosed in any of Japanese Patent Application Laid-Open No. 2006-221094, Japanese Patent Application Laid-Open No. H11-174705, and Japanese Patent Application Laid-Open No. H07-175252. Accordingly, the deterioration of an image due to a ghost phenomenon is susceptible to further alleviation.

In addition, when the energy level of any one of the compounds to be incorporated into the intermediate layers has an energy gap that absorbs an exposure wavelength, a problem in that the sensitivity of an electrophotographic photosensitive member deteriorates has also existed as a problem to be solved.

The present invention is an invention that has been made in view of the above-mentioned circumstances, and an object of the present invention is to provide an electrophotographic photosensitive member having the following feature: while the sensitivity of the photosensitive member is kept satisfactory, the deterioration of an image due to a ghost phenomenon of the photosensitive member is suppressed.

In addition, another object of the present invention is to provide a method of producing the electrophotographic photosensitive member.

Further, another object of the present invention is to provide a process cartridge and an electrophotographic apparatus each including the electrophotographic photosensitive member.

The present invention relates to an electrophotographic photosensitive member, including, in this order: a support; an intermediate layer containing a metal oxide; and a photosensitive layer, in which the intermediate layer contains at least one kind of compound X selected from the group consisting of a compound represented by the formula (1) and a compound represented by the formula (2):

(1)

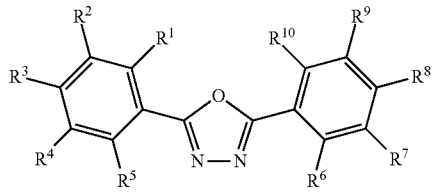

(2)

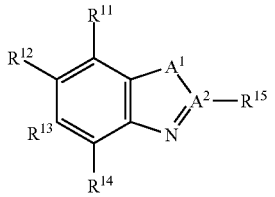

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

The present invention also relates to a method of producing the electrophotographic photosensitive member.

The present invention also relates to a process cartridge, including: the electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus.

The present invention also relates to an electrophotographic apparatus, including: the electrophotographic photosensitive member; a charging unit; an exposing unit; a developing unit; and a transferring unit.

As described above, according to the present invention, the electrophotographic photosensitive member having the following feature can be provided: while the sensitivity of the photosensitive member is kept satisfactory, the deterioration of an image due to a ghost phenomenon is suppressed.

In addition, according to the present invention, the method of producing the electrophotographic photosensitive member can be provided.

Further, according to the present invention, the process cartridge and the electrophotographic apparatus each including the electrophotographic photosensitive member can be provided.

Further features of the present invention will become apparent from the following description of exemplary embodiments with reference to the attached drawings.

DESCRIPTION OF THE EMBODIMENTS

Figure 1:
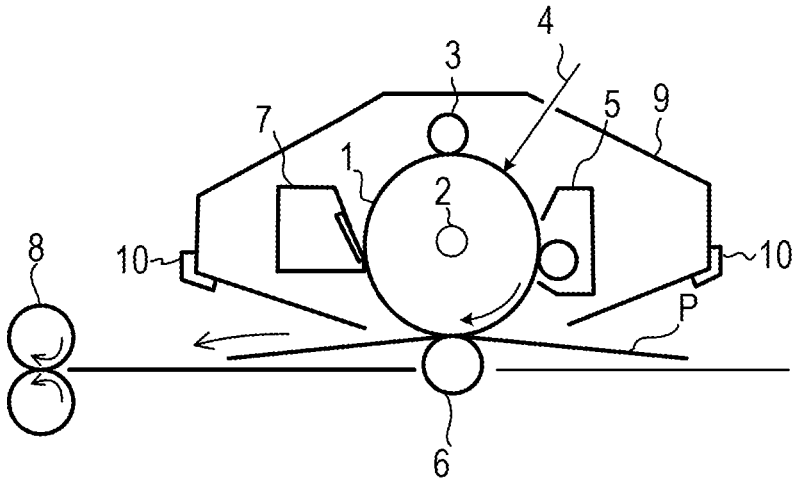
FIG. 1 is a view for illustrating an example of the schematic construction of an electrophotographic apparatus including a process cartridge including an electrophotographic photosensitive member of the present invention.

Preferred embodiments of the present invention will now be described in detail in accordance with the accompanying drawings.

The present invention relates to an electrophotographic photosensitive member including an intermediate layer that contains at least one kind of compound X selected from the group consisting of a compound represented by the formula (1) and a compound represented by the formula (2):

(1)

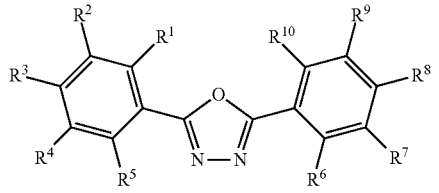

(2)

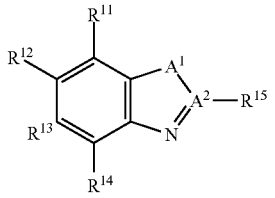

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

The present invention also relates to an electrophotographic photosensitive member in which the compound X is a compound represented by the formula (2'):

(2')

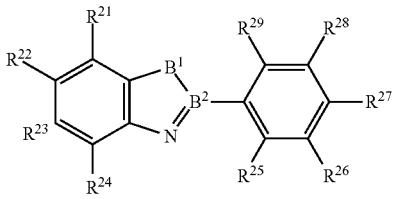

in the formula (2'), $B^1$ represents a carbon atom, a nitrogen atom, or an oxygen atom, when $B^1$ represents a carbon atom, $B^2$ represents a carbon atom or a nitrogen atom, when $B^1$ represents a nitrogen atom, $B^2$ represents a carbon atom, and when $B^1$ represents an oxygen atom, $B^2$ represents a carbon atom or a sulfur atom, $R^{21}$ to $R^{29}$ each independently represent a hydrogen atom, an alkyl group, a hydroxy group, a carboxy group, an amino group, an alkoxy group, and an aryl group, provided that $R^{24}$, $R^{25}$, or $R^{29}$ is limited to a hydroxy group or a carboxy group, and the aryl group may be substituted with an alkyl group, an aryl group, a halogen atom, a hydroxy group, or a carboxy group.

The alkyl group serving as any one of the $R^1$ to $R^{13}$, $R^{15}$, $R^{21}$ to $R^{23}$, and $R^{26}$ to $R^{28}$ may be any alkyl group, but examples thereof include a methyl group, an ethyl group, a n-propyl group, an isopropyl group, a n-butyl group, a s-butyl group, a t-butyl group, and an isobutyl group. One carbon atom in the main chain of any such alkyl group may be substituted with O or N. Examples of such group include a methoxymethyl group, an ethoxymethyl group, a 1-methoxyethyl group, a 2-methoxyethyl group, an N-methylaminomethyl group, an N-ethylaminomethyl group, a 1-(N-methylamino)ethyl group, a 2-(N-methylamino)ethyl group, and an N,N-dimethylaminomethyl group.

The alkoxy group serving as any one of the $R^1$ to $R^{13}$, $R^{15}$, $R^{21}$ to $R^{23}$, and $R^{26}$ to $R^{28}$ may be any alkoxy group, but examples thereof include a methoxy group, an ethoxy group, a n-propoxy group, an isopropoxy group, a n-butoxy group, a s-butoxy group, a t-butoxy group, and an isobutoxy group.

The aryloxy group serving as any one of the $R^1$ to $R^{13}$, $R^{15}$, $R^{21}$ to $R^{23}$, and $R^{26}$ to $R^{28}$ may be any aryloxy group, but examples thereof include a phenoxy group and a naphthoxy group.

Examples of the substituents of the alkyl group, the alkoxy group, and the aryloxy group include: the alkyl groups described in the foregoing; aryl groups, such as a phenyl group and a naphthyl group; halogen atoms, such as a fluorine atom, a chlorine atom, a bromine atom, and an iodine atom; and a carbonyl group. The alkyl group and the alkoxy group each having a carbonyl group serving as a substituent are each a group obtained by turning one or two or more carbon atoms of the alkyl group or the alkoxy group into carbonyl groups (C═O). Here, an alkyl group serving as a substituent may be substituted with an aryl group or a halogen atom serving as a substituent, and an aryl group serving as a substituent may be substituted with an alkyl group or a halogen atom serving as a substituent.

An excellent ghost phenomenon suppressing effect is exhibited by incorporating a metal oxide, and the at least one kind of compound X selected from the group consisting of the compound represented by the formula (1) and the compound represented by the formula (2) into the intermediate layer of the electrophotographic photosensitive member of the present invention. The inventors of the present invention have assumed a mechanism for the foregoing to be as described below.

The compound represented by the formula (1) has a structure having high polarity, having a wide conjugated system, and inhibiting the stacking of molecules of the compound. In particular, the compound includes a 1,3,4-oxadiazole structure, which is a five-membered ring having a nitrogen atom, and hence the compound may easily deliver charge. In addition, the compound represented by the formula (2) has a structure having high polarity and inhibiting the stacking of molecules of the compound because the compound has a nitrogen atom at a position shifting from its axis of symmetry. In addition, the compound represented by the formula (2) has the following property derived from the structure: when an electron is accepted from the photosensitive layer of the photosensitive member, the remaining of the electron in the compound hardly occurs. Accordingly, when electrons are accepted from the photosensitive layer, the remaining of the electrons in the compound represented by the formula (1) and the compound represented by the formula (2) hardly occurs. As a result, when the at least one kind of compound X selected from the group consisting of the compound represented by the formula (1) and the compound represented by the formula (2) is used in the intermediate layer, the flow of an electron from the photosensitive layer to the intermediate layer is smoothened, and hence the remaining of charge in the photosensitive layer responsible for a ghost can be suppressed.

In addition, in the intermediate layer of the electrophotographic photosensitive member of the present invention, the at least one kind of compound X selected from the group consisting of the compound represented by the formula (1) and the compound represented by the formula (2) preferably forms a complex with the metal oxide. When the compound represented by the formula (1) and the compound represented by the formula (2) forms the complex with the metal oxide, the stiffness of a complex forming portion is improved. Accordingly, the stiffness of the compound is improved, and hence energy at the time of the oxidation of the compound reduces. As a result, the remaining of electrons in the compound represented by the formula (1) and the compound represented by the formula (2) can be prevented. In addition, when the compound represented by the formula (1) and the compound represented by the formula (2) forms the complex with the metal oxide, a distance between the compound and the metal oxide shortens. By virtue of the foregoing, the acceptance of an electron from the photosensitive layer and the exchange of an electron between molecules of the metal oxide are smoothened. As a result, the remaining of charge in the photosensitive layer responsible for a ghost can be suppressed.

Whether or not the compound represented by the formula (1) and the compound represented by the formula (2) forms the complex with the metal oxide can be confirmed by the following method. For example, when the compound represented by the formula (1) and the compound represented by the formula (2) forms the complex with the metal oxide, the UV spectrum of the compound represented by the formula (1) and the compound represented by the formula (2) shifts to longer wavelengths by virtue of a bathochromic effect. Therefore, whether or not the compound represented by the formula (1) or the compound represented by the formula (2) forms the complex with the metal oxide can be judged based on the presence or absence of the bathochromic effect.

Specific exemplified compounds of the compound represented by the formula (1) are shown in Table 1 below, and specific exemplified compounds of the compound represented by the formula (2) are shown in Table 2 below. However, the present invention is not limited thereto.

TABLE 1

| | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| Compound 1 | H | H | H | H | H | H | H | H | H | H |
| Compound 2 | H | H | H | H | H | H | H | H | H | $CH_3$ |
| Compound 3 | H | H | H | H | H | H | H | H | H | O—$C_6H_5$ |
| Compound 4 | H | H | H | H | H | H | H | H | H | $NH_2$ |
| Compound 5 | H | H | H | H | H | $CH_3$ | H | $CH_3$ | H | $CH_3$ |

TABLE 1-continued

| | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| Compound 6 | H | H | $NH_2$ | H | H | H | H | $NH_2$ | H | H |
| Compound 7 | H | H | H | H | H | H | H | H | OH | H |
| Compound 8 | H | H | H | H | H | H | H | H | COOH | H |
| Compound 9 | H | OH | H | H | H | H | H | H | OH | H |
| Compound 10 | H | H | H | H | H | H | H | H | H | OH |
| Compound 11 | OH | H | H | H | H | H | H | H | H | OH |
| Compound 12 | H | H | H | H | H | H | H | OH | OH | OH |
| Compound 13 | H | H | H | H | H | H | H | H | H | COOH |
| Compound 14 | H | H | H | H | H | H | H | COOH | COOH | COOH |

TABLE 2

| | $A^1$ | $A^2$ | $R^{11}$ | $R^{12}$ | $R^{13}$ | $R^{14}$ | $R^{15}$ |
|---|---|---|---|---|---|---|---|
| Compound 15 | C | C | H | H | H | H | 2-Hydroxy-phenyl |
| Compound 16 | C | C | H | H | H | H | $C_6H_5$ |
| Compound 17 | C | C | H | H | H | OH | $C_6H_5$ |
| Compound 18 | C | C | H | H | H | OH | 2-Hydroxy-phenyl |
| Compound 19 | C | C | H | OH | H | H | $C_6H_5$ |
| Compound 20 | C | C | H | $C_6H_5$ | H | H | H |
| Compound 21 | C | C | H | H | H | $NH_2$ | $C_6H_5$ |
| Compound 22 | C | C | H | H | H | COOH | $C_6H_5$ |
| Compound 23 | C | N | H | H | H | OH | $C_6H_5$ |
| Compound 24 | N | C | H | H | H | OH | $C_6H_5$ |
| Compound 25 | O | S | H | H | H | OH | $C_6H_5$ |
| Compound 26 | O | C | H | H | H | OH | $C_6H_5$ |

Of the compounds each represented by the formula (1) shown in Table 1, a compound in which at least one of $R^1$ to $R^{10}$ in the formula (1) represents a hydroxy group or a carboxy group is preferred because a large dipole moment is obtained. Of such compounds, in particular, a compound in which at least one of $R^1$, $R^5$, $R^6$, or $R^{10}$ represents a hydroxy group or a carboxy group is more preferred because the compound more easily forms the complex with the metal oxide.

Of the compounds each represented by the formula (2) shown in Table 2, a compound in which $R^{15}$ represents a phenyl group is more preferred in terms of steric hindrance. A compound in which at least one of $R^{11}$ to $R^{14}$ in the formula (2) or at least one of $R^{21}$ to $R^{29}$ in the formula (2') represents a hydroxy group or a carboxy group is more preferred in terms of a dipole moment, and in particular, a compound in which $R^{14}$, and at least one of $R^{24}$, $R^{25}$, and $R^{29}$ represents a hydroxy group or a carboxy group is still more preferred in terms of the formation of the complex with the metal oxide.

In addition, the content of the at least one kind of compound X selected from the group consisting of the compound represented by the formula (1) and the compound represented by the formula (2) in the intermediate layer is preferably 0.05 mass % or more and 20 mass % or less with respect to the metal oxide in the intermediate layer. When the content is 0.05 mass % or more, the compound represented by the formula (1) or the compound represented by the formula (2) and the particles of the metal oxide sufficiently interact with each other, and hence a potential fluctuation suppressing effect becomes higher. Accordingly, an excellent ghost suppressing effect is obtained.

In the present invention, titanium oxide, zinc oxide, tin oxide, zirconium oxide, or aluminum oxide is available as the metal oxide to be incorporated into the intermediate layer, and any such metal oxide is preferably incorporated in terms of electroconductivity. Titanium oxide, zinc oxide, or tin oxide is more preferably incorporated. In addition, the surface of the metal oxide may be treated with a surface treatment agent, such as a silane coupling agent.

In the present invention, the intermediate layer may contain a binder resin in addition to the metal oxide, and the at least one kind of compound X selected from the group consisting of the compound represented by the formula (1) and the compound represented by the formula (2). Examples of the binder resin include an acrylic resin, an allyl resin, an alkyd resin, an ethylcellulose resin, an ethylene-acrylic acid copolymer, an epoxy resin, a casein resin, a silicone resin, a gelatin resin, a phenol resin, a butyral resin, polyacrylate, polyacetal, polyamide imide, polyamide, polyallyl ether, polyimide, polyurethane, polyester, polyethylene, polycarbonate, polystyrene, polysulfone, polyvinyl alcohol, polybutadiene, and polypropylene. Of those, a butyral resin and polyurethane are preferred.

The content of the binder resin in the intermediate layer is preferably 10 mass % or more and 50 mass % or less with respect to the metal oxide. When the content falls within such range, the uniformity of the coat of the intermediate layer becomes satisfactory.

Figure 2:
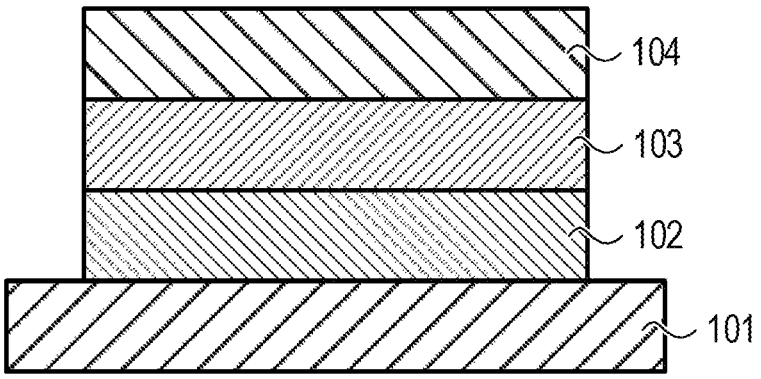
FIG. 2 is a view for illustrating an example of the layer construction of the electrophotographic photosensitive member of the present invention.

The electrophotographic photosensitive member of the present invention includes, in this order, a support, the intermediate layer, and the photosensitive layer including a charge generating layer and a charge transporting layer, for example, as illustrated in FIG. 2. In FIG. 2, the support is represented by reference numeral 101, the intermediate layer is represented by reference numeral 102, the charge generating layer is represented by reference numeral 103, and the charge transporting layer is represented by reference numeral 104.

Examples of the photosensitive layer include: a single-layer photosensitive layer (not shown) containing a charge generating substance and a charge transporting substance in a single layer; and a laminated (function-separated) photosensitive layer separated into the charge generating layer 103 containing the charge generating substance and the charge transporting layer 104 containing the charge transporting substance. In the present invention, a laminated (function-separated) photosensitive layer having the charge generating layer 103 and the charge transporting layer 104 formed on the charge generating layer 103 is preferred. In addition, a protective layer (not shown) may be further formed on the photosensitive layer.

The respective layers are described below.

[Support]

The support to be used in the present invention is preferably an electroconductive support. For example, the following supports may each be used as the electroconductive support: a support formed of a metal, such as aluminum, iron, stainless steel, nickel, copper, zinc, or gold, or an alloy thereof; and a support obtained by forming, on an insulating support, such as a polyester resin, a polycarbonate resin, a polyimide resin, or glass, a thin film of a metal, such as aluminum, chromium, silver, or gold, a thin film formed out of an electroconductive material, such as indium oxide, tin oxide, or zinc oxide, by vacuum deposition, or a thin film of an electroconductive ink having added thereto a silver nanowire. In the case of a support made of aluminum or an aluminum alloy, an ED tube, an EI tube, or a product obtained by subjecting any such tube to cutting, electrolytic composite polishing (electrolysis with an electrode having an electrolytic action and an electrolytic solution, and polishing with a grindstone having a polishing action), or a wet or dry honing treatment may be used. In addition, the support may be, for example, a metal support or a support obtained by forming, on a resin support, a thin film of an electroconductive material, such as aluminum, an aluminum alloy, or an indium oxide-tin oxide alloy. In addition, examples of the shape of the support include a cylindrical shape and a belt shape. Of those, a cylindrical shape is preferred.

The surface of the support may be subjected to an electrochemical treatment, such as anodic oxidation, a wet honing treatment, a blast treatment, a cutting treatment, a surface roughening treatment, or an alumite treatment for the purpose of improving its electrical characteristics, or suppressing interference fringes due to the scattering of laser light.

(Electroconductive Layer)

In the present invention, an electroconductive layer may be arranged between the support and the intermediate layer to be described later for the purpose of, for example, suppressing interference fringes due to the scattering of laser light or covering a flaw in the support. The electroconductive layer may be formed by: applying a coating liquid for an electroconductive layer obtained by dispersing carbon black and/or electroconductive particles together with a binder resin and a solvent; and heat-drying (thermally curing) the applied liquid.

Examples of the electroconductive particles include metal oxide particles of zinc oxide, white lead, aluminum oxide, indium oxide, silicon oxide, zirconium oxide, tin oxide, titanium oxide, magnesium oxide, antimony oxide, bismuth oxide, indium oxide doped with tin, tin oxide doped with antimony or tantalum, and zirconium oxide. Of those, metal oxide particles each containing zinc oxide, titanium oxide, or tin oxide are preferred. In addition, the surfaces of the metal oxide particles may be treated with a silane coupling agent or the like in order that the dispersibility of the metal oxide particles may be improved. Further, the metal oxide particles may each be doped with another metal or metal oxide in order that the resistance of the electroconductive layer may be controlled.

Examples of the binder resin to be used in the electroconductive layer include polyester, polycarbonate, polyvinyl butyral, an acrylic resin, a silicone resin, an epoxy resin, a melamine resin, a urethane resin, a phenol resin, and an alkyd resin.

Examples of the solvent of the coating liquid for an electroconductive layer include an ether-based solvent, an alcohol-based solvent, a sulfoxide-based solvent, a ketone-based solvent, an ester-based solvent, and an aromatic hydrocarbon-based solvent. As a dispersion method for dispersing the metal oxide particles in the coating liquid for an electroconductive layer, there is given a method involving using a paint shaker, a sand mill, a ball mill, or a liquid collision-type high-speed disperser.

The average thickness of the electroconductive layer is preferably 5 μm or more and 40 μm or less, more preferably 10 μm or more and 30 μm or less.

[Intermediate Layer]

The intermediate layer containing the metal oxide, and the at least one kind of compound X selected from the group consisting of the compound represented by the formula (1) and the compound represented by the formula (2) is arranged between the support or the electroconductive layer and the photosensitive layer.

In the present invention, the metal oxide to be incorporated into the intermediate layer is not particularly limited as long as the metal oxide is used for the purpose of imparting electroconductivity to the intermediate layer. Of such metal oxides, a metal oxide, such as titanium oxide, zinc oxide, tin oxide, zirconium oxide, or aluminum oxide, is preferred from the viewpoint of imparting proper electroconductivity. Of those, titanium oxide, zinc oxide, or tin oxide is particularly preferred.

In addition, in the present invention, metal oxide particles are preferably used as the metal oxide. The average primary particle diameter of the metal oxide particles is preferably 50 nm or more and 500 nm or less, more preferably 50 nm or more and 300 nm or less. The average primary particle diameter of the metal oxide particles is obtained by: observing a section of the intermediate layer with a scanning electron microscope (SEM) or the like; measuring the particle diameters of 100 arbitrary particles; and determining the average of the measured values.

The surfaces of the metal oxide particles may be treated with a surface treatment agent. Any method may be used as a method for the surface treatment as long as the method is a known method, and a dry method or a wet method is used.

Examples of the surface treatment agent include organic compounds, such as a silane coupling agent, a titanate-based coupling agent, an aluminum-based coupling agent, and a surfactant. Of those, a silane coupling agent is preferred, and a silane coupling agent having an amino group is particularly preferred.

Specific examples of the silane coupling agent having an amino group include N-2-(aminoethyl)-3-aminopropylmethyldimethoxysilane, 3-aminopropylmethyldiethoxysilane, (phenylaminomethyl)methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, N-2-(aminoethyl)-3-aminopropyltrimethoxysilane, (phenylaminomethyl)trimethoxysilane, N-2-(aminoethyl)-3-aminoisobutyltrimethoxysilane, N-ethylaminoisobutyltriethoxysilane, and N-methylaminopropyltrimethoxysilane. However, the present invention is not limited thereto. In addition, two or more kinds thereof may be used as a mixture.

When the surface treatment is performed by the dry method, the treatment is performed as follows: while the metal oxide particles are stirred with, for example, a mixer having a large shear force, the surface treatment agent is directly added or added dropwise after having been dissolved in an organic solvent, or the agent is sprayed together with dry air or a nitrogen gas. The addition or the spraying is desirably performed at a temperature equal to or less than the boiling point of the solvent. Baking may be further performed at 100° C. or more after the addition or the spraying. The baking is performed at a temperature in any range for a time period in any range.

The treatment by the wet method involves: stirring the metal oxide particles in a solvent; dispersing the particles with an ultrasonic wave, a sand mill, an attritor, a ball mill, or the like; adding the surface treatment agent to the resultant; stirring or dispersing the contents; and then removing the solvent. The solvent is removed by filtration or distillation. Baking may be further performed at 100° C. or more after the removal of the solvent. The temperature at, and the time period for, which the baking is performed are not particularly limited as long as an electrophotographic characteristic is obtained.

The content of the surface treatment agent in the intermediate layer is preferably 0.5 mass % or more and 20 mass % or less with respect to the metal oxide particles from the viewpoint of the electrophotographic characteristic.

In addition, a mixture of two or more kinds of particles, such as particles formed of different kinds of metal oxides, particles subjected to different surface treatments, or particles having different particle diameters, may be used as the metal oxide particles.

Further, the metal oxide particles may be particles coated with at least one of alumina or silica. When the particles are coated with at least one of alumina or silica, their compatibility with the binder resin of the intermediate layer is improved, and hence a black spot suppressing effect can be improved.

In addition, an additive may be further incorporated into the intermediate layer. Examples of the additive include: hydrophobic organic resin particles, such as silicone particles; hydrophilic organic resin particles, such as cross-linked polymethyl methacrylate resin (PMMA) particles; and a leveling agent. Of those, PMMA particles are particularly preferred because the use of the particles can adjust the surface roughness of the intermediate layer within a proper range, and hence can uniformize the film.

In the present invention, the intermediate layer is formed through: a step of preparing a coating liquid for an intermediate layer containing the metal oxide, the at least one kind of compound X selected from the group consisting of the compound represented by the formula (1) and the compound represented by the formula (2), and the binder resin; a step of forming a coat of the coating liquid for an intermediate layer; and a step of drying the coat to form the intermediate layer. The coating liquid for an intermediate layer only needs to be prepared in accordance with constituent components for the intermediate layer.

The coating liquid for an intermediate layer is prepared by: dissolving the at least one kind of compound X selected from the group consisting of the compound represented by the formula (1) and the compound represented by the formula (2) in a solvent; and adding a liquid having dissolved therein the binder resin and the metal oxide to the solution. In addition, the coating liquid for an intermediate layer may be prepared by: adding the liquid having dissolved therein the binder resin to a dispersion liquid obtained by subjecting the metal oxide, and the at least one kind of compound X selected from the group consisting of the compound represented by the formula (1) and the compound represented by the formula (2) to a dispersion treatment together with the solvent; and further subjecting the mixture to a dispersion treatment. A method for the dispersion is, for example, a method involving using a homogenizer, an ultrasonic disperser, a ball mill, a sand mill, a roll mill, a vibration mill, an attritor, or a liquid collision-type high-speed disperser.

The intermediate layer may be formed by: a step of applying the coating liquid for an intermediate layer prepared by the above-mentioned method onto the support or the electroconductive layer first to form a coat; and a step of drying the coat. Heat drying or blast drying is used as a method of drying the coat, and the method may be arbitrarily set in consideration of the curing temperature and curing time of the resin to the extent that desired characteristics of the electrophotographic photosensitive member are obtained.

Examples of the coating method for the intermediate layer include coating methods, such as a dip coating method, a spray coating method, a spinner coating method, a bead coating method, a blade coating method, and a beam coating method.

Examples of the solvent to be used in the coating liquid for an intermediate layer include organic solvents, such as an alcohol-based solvent, a sulfoxide-based solvent, a ketone-based solvent, an ether-based solvent, an ester-based solvent, an aliphatic halogenated hydrocarbon-based solvent, and an aromatic compound. For example, methylal, tetrahydrofuran, methanol, ethanol, isopropyl alcohol, butyl alcohol, methyl cellosolve, methoxy propanol, acetone, methyl ethyl ketone, cyclohexanone, methyl acetate, ethyl acetate, dioxane, and tetrahydrofuran are appropriately used. In addition, those solvents to be used in the coating liquid for an intermediate layer may be used alone or as a mixture thereof.

The average thickness of the intermediate layer is preferably 0.5 μm or more and 40 μm or less, more preferably 1 μm or more and 30 μm or less.

[Photosensitive Layer]

The photosensitive layer (the charge generating layer 103 and the charge transporting layer 104) is formed on the intermediate layer.

(Charge Generating Layer)

Examples of the charge generating substance to be used in the present invention include an azo pigment, a phthalocyanine pigment, an indigo derivative, a perylene pigment, an anthraquinone derivative, a dibenzpyrenequinone derivative, a squarylium dye, a thiapyrylium salt, a triphenylmethane dye, a quinacridone pigment, an azulenium salt pigment, a cyanine colorant, an anthanthrone derivative, a pyranthrone derivative, a violanthrone derivative, an isoviolanthrone derivative, an indigo derivative, a thioindigo derivative, a bisbenzimidazole derivative, a xanthene dye, a quinoneimine dye, and a styryl dye. Of those charge generating substances, a phthalocyanine pigment or an azo pigment is preferred from the viewpoint of sensitivity, and a phthalocyanine pigment is more preferred. Those charge generating substances may be used alone or in combination thereof.

Of the phthalocyanine pigments, in particular, an oxytitanium phthalocyanine, a chlorogallium phthalocyanine, or a hydroxygallium phthalocyanine shows excellent charge generation efficiency. Further, of the hydroxygallium phthalocyanines, a hydroxygallium phthalocyanine crystal of a crystal form having strong peaks at Bragg angles 2θ in CuKα characteristic X-ray diffraction of 7.4°±0.3° and 28.2°±0.3° is more preferred from the viewpoints of sensitivity and a potential characteristic.

Examples of the binder resin to be used in the charge generating layer 103 include a polymer or a copolymer of a vinyl compound, such as ethylene, butadiene, propylene, styrene, vinyl acetate, vinyl chloride, an acrylate, a methacrylate, vinylidene fluoride, trifluoroethylene, a styrene-butadiene copolymer, or a vinyl chloride-vinyl acetate copolymer, polyvinyl alcohol, polyvinyl acetal, polycarbonate, polyester, polysulfone, polyphenylene oxide, an acrylic resin, an allyl resin, an alkyd resin, an epoxy resin, a diallyl phthalate resin, a butyral resin, a benzal resin, polyacetal, polyamide imide, polyamide, polyallyl ether, polyarylate, polyimide, polyurethane, and a urea resin. Of those, a polyester resin, a polycarbonate resin, and a polyvinyl acetal resin are preferred, a polyvinyl acetal resin is more preferred, and a butyral resin is particularly preferred. Those resins may be used alone or as a mixture thereof.

With regard to a ratio between the charge generating substance and the binder resin in the charge generating layer 103, the amount of the charge generating substance is preferably 0.3 part by mass or more and 10 parts by mass or less with respect to 1 part by mass of the binder resin.

The charge generating layer 103 may be formed by: applying a coating liquid for a charge generating layer obtained by subjecting the charge generating substance to a dispersion treatment together with the binder resin and a solvent to form a coat; and drying the resultant coat. In addition, the charge generating layer 103 may be a deposited film of the charge generating substance.

Examples of the solvent to be used in the coating liquid for a charge generating layer include an alcohol-based solvent, a sulfoxide-based solvent, a ketone-based solvent, an ether-based solvent, an ester-based solvent, an aliphatic halogenated hydrocarbon-based solvent, and an aromatic compound. A method of dispersing the charge generating substance, the binder resin, and the solvent is, for example, a method involving using a homogenizer, an ultrasonic disperser, a ball mill, a sand mill, a roll mill, a vibration mill, an attritor, or a liquid collision-type high-speed disperser.

In addition, various sensitizers, antioxidants, UV absorbers, and plasticizers may each be added to the charge generating layer 103 as required.

The average thickness of the charge generating layer 103 is preferably 0.01 μm or more and 5 μm or less, more preferably 0.1 μm or more and 2 μm or less.

(Charge Transporting Layer)

In the electrophotographic photosensitive member including the laminated photosensitive layer, the charge transporting layer 104 is formed on the charge generating layer 103.

Examples of the charge transporting substance to be used in the present invention include a polycyclic aromatic compound, a heterocyclic compound, a triarylamine compound, such as triphenylamine, a hydrazone compound, a styryl compound, a stilbene compound, an enamine compound, a benzidine compound, and a butadiene compound. In addition, examples of the charge transporting substance also include polymers each having, in a main chain or a side chain thereof, a group derived from any of those compounds. Of those, a triarylamine compound and a benzidine compound are preferred from the viewpoints of the mobility of charge and the potential stability at the time of repeated use. Those charge transporting substances may be used alone or in combination thereof.

Examples of the binder resin to be used in the charge transporting layer 104 include polyester, an acrylic resin, a phenoxy resin, polycarbonate, polystyrene, polyvinyl acetate, polysulfone, polyarylate, an acrylonitrile resin, an allyl resin, an alkyd resin, an epoxy resin, a silicone resin, a phenol resin, polyacrylamide, polyamide imide, polyamide, polyallyl ether, polyimide, polyurethane, polyethylene, polyphenylene oxide, polybutadiene, polypropylene, a methacrylic resin, polyvinylidene chloride, and an acrylonitrile copolymer. Of those, polyarylate or polycarbonate is preferred. Those binder resins may be used alone or as a mixture thereof.

With regard to a ratio between the charge transporting substance and the binder resin in the charge transporting layer 104, the amount of the charge transporting substance is preferably 0.3 part by mass or more and 10 parts by mass or less with respect to 1 part by mass of the binder resin.

The charge transporting layer 104 may be formed by: applying a coating liquid for a charge transporting layer obtained by dissolving the charge transporting substance and the binder resin in a solvent; and drying the resultant coat. In addition, when the charge transporting layer 104 is of a laminated construction, the charge transporting layer 104 may be formed by: applying the coating liquid for a charge transporting layer obtained by dissolving the charge transporting substance and the binder resin in the solvent to form a coat; and drying the coat. In addition, a drying temperature is preferably 60° C. or more and 150° C. or less, more preferably 80° C. or more and 120° C. or less from the viewpoint of the suppression of a crack in the charge transporting layer 104. In addition, a drying time is preferably 10 minutes or more and 60 minutes or less.

Examples of the solvent to be used in the coating liquid for a charge transporting layer include an alcohol-based solvent, a sulfoxide-based solvent, a ketone-based solvent, an ether-based solvent, an ester-based solvent, an aliphatic halogenated hydrocarbon-based solvent, and an aromatic hydrocarbon-based solvent.

In addition, an antioxidant, a UV absorber, a plasticizer, or the like may be added to the charge transporting layer 104 as required.

When the charge transporting layer 104 of the electrophotographic photosensitive member is single layer, the average thickness of the charge transporting layer 104 is preferably 5 μm or more and 40 μm or less, more preferably 8 μm or more and 30 μm or less. When the charge transporting layer 104 is of a laminated construction having two or more layers, the average thickness of a charge transporting layer on the support side is preferably 5 μm or more and 30 μm or less, and the average thickness of a charge transporting layer on a surface side is preferably 1 μm or more and 10 μm or less.

(Protective Layer)

In addition, in the present invention, a protective layer (second charge transporting layer) may be arranged on the photosensitive layer (charge transporting layer 104) for the purpose of, for example, protecting the photosensitive layer to improve its abrasion resistance or cleaning property.

The protective layer may be formed by: applying a coating liquid for a protective layer obtained by dissolving a binder resin in an organic solvent; and drying the resultant coat. Examples of the resin to be used in the protective layer include polyvinyl butyral, polyester, polycarbonate, polyimide, polyimide, polyarylate, polyurethane, a styrene-butadiene copolymer, a styrene-acrylic acid copolymer, and a styrene-acrylonitrile copolymer.

In addition, in order that a charge transporting ability may be imparted to the protective layer, the protective layer may be formed by curing a monomer material having a charge transporting ability or a polymer-type charge transporting substance through the use of various crosslinking reactions. The protective layer is preferably formed by polymerizing or crosslinking a charge transportable compound having a chain-polymerizable functional group to cure the compound. Examples of the chain-polymerizable functional group include an acryloyl group, a methacryloyl group, an alkoxysilyl group, and an epoxy group. A reaction for the curing is, for example, radical polymerization, ionic polymerization, thermal polymerization, photopolymerization, radiation polymerization (electron beam polymerization), a plasma CVD method, or a photo-CVD method.

The average thickness of the protective layer is preferably 0.5 μm or more and 10 μm or less, more preferably 1 μm or more and 7 μm or less. In addition, electroconductive particles or the like may be added to the protective layer as required.

A lubricant, for example, a silicone oil, a wax, fluorine atom-containing resin particles, such as polytetrafluoroethylene particles, silica particles, alumina particles, or boron nitride may be incorporated into the outermost surface layer (the charge transporting layer 104 or the protective layer) of the electrophotographic photosensitive member.

In the application of the coating liquid for each layer, there may be used, for example, a coating method, such as a dip coating method, a spray coating method, a spinner coating method, a roller coating method, a Mayer bar coating method, or a blade coating method.

[Process Cartridge and Electrophotographic Apparatus]

A process cartridge of the present invention integrally supports the electrophotographic photosensitive member described in the foregoing, and at least one unit selected from the group consisting of a charging unit, a developing unit, and a cleaning unit, and is removably mounted onto the main body of an electrophotographic apparatus.

In addition, an electrophotographic apparatus of the present invention includes the electrophotographic photosensitive member described in the foregoing, a charging unit, an exposing unit, a developing unit, and a transferring unit.

The schematic construction of an electrophotographic apparatus including a process cartridge 9 including an electrophotographic photosensitive member 1 of the present invention is illustrated in FIG. 1.

In FIG. 1, the cylindrical electrophotographic photosensitive member 1 is rotationally driven about an axis 2 in a direction indicated by the arrow at a predetermined peripheral speed. The surface of the electrophotographic photosensitive member 1 to be rotationally driven is uniformly charged to a predetermined positive or negative potential by a charging unit (primary charging unit: e.g., a charging roller) 3 in its rotation process. Next, the charged surface of the electrophotographic photosensitive member 1 receives exposure light (image exposure light) 4 whose intensity has been modulated in correspondence with a time-series electric digital image signal of information on a desired image output from an exposing unit (not shown), such as slit exposure or laser beam scanning exposure. Thus, electrostatic latent images corresponding to the desired image are sequentially formed on the surface of the electrophotographic photosensitive member 1. A voltage to be applied to the charging unit 3 may be only a DC voltage, or may be a DC voltage having superimposed thereon an AC voltage.

The electrostatic latent images formed on the surface of the electrophotographic photosensitive member 1 are developed (normal development or reversal development) with toner in the developer of a developing unit 5 to form toner images on the surface of the electrophotographic photosensitive member 1. Next, the toner images formed on and carried by the surface of the electrophotographic photosensitive member 1 are sequentially transferred onto a transfer material (e.g., paper) P by a transfer bias from a transferring unit (e.g., a transfer roller) 6. The transfer material P is taken out and supplied from a transfer material supplying unit (not shown) to a space (abutment portion) between the electrophotographic photosensitive member 1 and the transferring unit 6 in synchronization with the rotation of the electrophotographic photosensitive member 1. In addition, a bias voltage opposite in polarity to charge that the toner possesses is applied from a bias power source (not shown) to the transferring unit 6.

The transfer material P onto which the toner images have been transferred from the electrophotographic photosensitive member 1 is separated from the surface of the electrophotographic photosensitive member 1 and conveyed to a fixing unit 8 where the toner images are subjected to a fixation treatment. Thus, the transfer material is conveyed as an image-formed product (a print or a copy) to the outside of the apparatus.

The surface of the electrophotographic photosensitive member 1 after the transfer of the toner images onto the transfer material P is cleaned through the removal of a transfer residual developer (transfer residual toner) by a cleaning unit (e.g., a cleaning blade) 7. In recent years, a cleaner-less system has been developed and hence the transfer residual toner can be directly removed with the developing unit 5 or the like. Next, the surface is subjected to an antistatic treatment by pre-exposure light (not shown) from a pre-exposing unit (not shown), and is then repeatedly used in image formation. When the charging unit 3 is a contact charging unit using a charging roller or the like as illustrated in FIG. 1, pre-exposure is not necessarily needed.

In the present invention, a plurality of components may be selected from the components, such as the electrophotographic photosensitive member 1, the charging unit 3, the developing unit 5, the transferring unit 6, and the cleaning unit 7, and be stored in a container and integrally supported to form the process cartridge 9. In addition, the process cartridge 9 may be removably mounted onto the main body of an electrophotographic apparatus, such as a copying machine or a laser beam printer. In FIG. 1, the electrophotographic photosensitive member 1, the charging unit 3, the developing unit 5, and the cleaning unit 7 are integrally supported to form a cartridge, and the cartridge is caused to serve as the process cartridge 9 removably mounted onto the main body of the electrophotographic apparatus by using a guiding unit 10, such as the rail of the main body of the electrophotographic apparatus.

Further, for example, when the electrophotographic apparatus is a copying machine or a printer, the exposure light 4 may be reflected light or transmitted light from an original. Alternatively, the exposure light 4 may be light radiated by, for example, scanning with a laser beam, the driving of an LED array, or the driving of a liquid crystal shutter array to be performed in accordance with a signal turned from the original read with a sensor.

EXAMPLES

The present invention is described in more detail below by way of specific Examples. However, the present invention is not limited thereto. The terms and "part(s)" in Examples mean "mass" and "part(s) by mass", respectively.

[Production of Coating Liquid 1 for Intermediate Layer]

100 Parts of zinc oxide particles (number-average primary particle diameter: 50 nm, specific surface area (hereinafter referred to as "BET value"): 19.2 $m^2/g$, powder resistance: $3.0\times10^7$ Ω·cm) were mixed with 500 parts of toluene under stirring, and 1.0 part of N-2-(aminoethyl)-3-aminopropyltrimethoxysilane (trade name: KBM-603, manufactured by Shin-Etsu Chemical Co., Ltd.) was added to the mixture, followed by stirring for 2 hours. After that, toluene was removed by distillation under reduced pressure and the residue was baked at 120° C. for 3 hours. Thus, surface-treated zinc oxide particles M1 were obtained.

Next, 1.88 parts of polyvinyl butyral (trade name: BM-1, manufactured by Sekisui Chemical Co., Ltd.) and 4.74 parts of a blocked isocyanate (trade name: SUMIDUR BL3175, manufactured by Sumika Covestro Urethane Co., Ltd. (former Sumika Bayer Urethane Co., Ltd.)) were dissolved in a mixed solvent containing 42.5 parts of methyl ethyl ketone and 42.5 parts of 1-butanol. 50.0 Parts of the zinc oxide particles M1 and 1.0 part of the compound 1 having the structure shown in Table 1 were added to the resultant liquid, and the mixture was dispersed with a sand mill apparatus using glass beads each having a diameter of 0.9 mm under an atmosphere at 23±3° C. for 3 hours. After the dispersion, 3.4 parts of silicone particles (trade name: TOSPEARL 120, manufactured by Momentive Performance Materials Japan LLC) serving as resin fine particles and 0.007 part of a silicone oil (trade name: SH28PA, manufactured by Dow Corning Toray Co., Ltd. (former Toray Dow Corning Silicone Co., Ltd.)) were added to the resultant, and the mixture was stirred and then left to stand in a roll stand having a number of revolutions of 60 rpm under an atmosphere at 23±3° C. for 1 day. Thus, a coating liquid 1 for an intermediate layer was produced.

[Production of Coating Liquids 2 to 19 and 31 to 46 for Intermediate Layers]

Coating liquids were each produced in the same manner as in the coating liquid 1 for an intermediate layer except that in the coating liquid 1 for an intermediate layer, the metal oxide particles, the binder resin, the solvent, and the compound were changed as shown in Table 3.

[Production of Coating Liquid 20 for Intermediate Layer]

Rutile-type titanium oxide particles (trade name: PT-401M, manufactured by Ishihara Sangyo Kaisha, Ltd., number-average primary particle diameter: 70 nm, BET value: 20.5 $m^2/g$, powder resistance: $7.0\times10^3$ Ω·cm) and 3 parts by mass of methyldimethoxysilane (trade name: TEL 8117, manufactured by Toshiba Silicone Co., Ltd.) with respect to 100 parts by mass of the titanium oxide particles were loaded into a high-speed fluid-type mixing kneader (apparatus name: SMG-300, manufactured by Kawata MFG Co., Ltd.), and were mixed at a rotational peripheral speed as high as 34.5 m/sec for 2 hours to provide hydrophobic-treated titanium oxide. The hydrophobic-treated titanium oxide was dispersed in a mixed solvent containing 87.5 parts of methanol and 12.5 parts of 1-propanol with a ball mill. Thus, a dispersed slurry of hydrophobic-treated titanium oxide was obtained.

Methanol, 1-propanol, and toluene, and N-methoxymethylated nylon powder (trade name: TORESIN F-30K, manufactured by Nagase ChemteX Corporation, degree of methoxymethylation: about 30%) and the compound 10 were further added to the dispersed slurry, and the N-methoxymethylated nylon was dissolved by stirring and mixing the contents while warming the contents to 60° C. After that, an ultrasonic dispersion treatment was performed to prepare a dispersion liquid having a solid content concentration of mass %, the liquid having a mass ratio "methanol/1-propanol/toluene" of 7/1/2 and containing the hydrophobic-treated titanium oxide, the N-methoxymethylated nylon, and the compound 10 at a mass ratio of 3/1/0.06. Thus, a coating liquid 20 for an intermediate layer was produced.

[Production of Coating Liquid 21 for Intermediate Layer]

A coating liquid was produced in the same manner as in the coating liquid 20 for an intermediate layer except that in the coating liquid 20 for an intermediate layer, the rutile-type titanium oxide particles were changed to rutile-type titanium oxide particles having a number-average primary particle diameter of 130 nm (trade name: PT-401L, manufactured by Ishihara Sangyo Kaisha, Ltd., BET value: 11.2 $m^2/g$, powder resistance: $1.8\times10^3$ Ω·cm).

[Production of Coating Liquid 47 for Intermediate Layer]

Rutile-type titanium oxide particles (trade name: PT-401L, manufactured by Ishihara Sangyo Kaisha, Ltd., average primary particle diameter: 130 nm) and 3 parts by mass of methyldimethoxysilane ("TSL 8117" manufactured by Toshiba Silicone Co., Ltd.) with respect to 100 parts by mass of the titanium oxide particles were loaded into a high-speed fluid-type mixing kneader ("SMG-300" manufactured by Kawata MFG Co., Ltd.), and were mixed at a rotational peripheral speed as high as 34.5 m/sec to provide surface-treated titanium oxide T-1. The resultant surface-treated titanium oxide T-1 was dispersed in a mixed solvent containing methanol and 1-propanol with a ball mill. Thus, a dispersed slurry of hydrophobic-treated titanium oxide was obtained.

Methanol, 1-propanol, and toluene, and N-methoxymethylated nylon (trade name: TORESIN F-30K, manufactured by Nagase ChemteX Corporation, degree of methoxymethylation: about 30%) powder and the compound 1 were further added to the dispersed slurry obtained here, and the nylon powder was dissolved by stirring and mixing the contents while warming the contents. After that, an ultrasonic dispersion treatment was performed to finally prepare a dispersion liquid having a solid content concentration of 18 wt %, the liquid having a weight ratio "methanol/1-propanol/toluene" of 7/1/2 and containing the hydrophobic-treated titanium oxide, the N-methoxymethylated nylon, and the compound 1 at a weight ratio of 3/1/0.06. The dispersion liquid was defined as a coating liquid 47 for an intermediate layer.

[Production of Coating Liquid 51 for Intermediate Layer]

A coating liquid was produced in the same manner as in the coating liquid 1 for an intermediate layer except that in the coating liquid 1 for an intermediate layer, the compound 1 was not used.

[Production of Coating Liquid 52 for Intermediate Layer]

A coating liquid was produced in the same manner as in the coating liquid 1 for an intermediate layer except that in the coating liquid 1 for an intermediate layer, the compound 1 was changed to 2,5-bis(3-methoxyphenyl)-1,3,4-oxadiazole.

[Production of Coating Liquid 53 for Intermediate Layer]

A coating liquid 53 for an intermediate layer was produced in the same manner as in the method of producing the coating liquid 1 for an intermediate layer except that the compound 1 was changed to 2,3-dihydroxyanthraquinone.

[Production of Coating Liquid 54 for Intermediate Layer]

A coating liquid 54 for an intermediate layer was produced in the same manner as in the method of producing the coating liquid 1 for an intermediate layer except that the metal oxide was not used.

[Verification Method for Formation of Complex in Coating Liquid for Intermediate Layer]

Verification that a compound represented by the formula (1) and a compound represented by the formula (2) formed a complex with a metal oxide was performed by the following method.

A coating liquid for an intermediate layer was prepared as described in the foregoing, and the coating liquid for an intermediate layer was diluted with a dispersion solvent for an intermediate layer so as to have a concentration 1/100 that before the dilution. A UV spectrum measured for a solution obtained by dissolving the compound represented by the formula (1) or the compound represented by the formula (2)

with the dispersion solvent for an intermediate layer, and a UV spectrum measured for the solution obtained by diluting the coating liquid for an intermediate layer were compared to each other. As a result, the UV spectrum of the solution obtained by diluting the coating liquid for an intermediate layer shifted to longer wavelengths, and hence it was confirmed that the compound represented by the formula (1) and the compound represented by the formula (2) and the metal oxide formed the complex.

Example 1

An aluminum cylinder having a diameter of 24 mm (JIS-A3003, aluminum alloy, length: 257.5 mm) was used as a support (electroconductive support).

Next, the coating liquid 1 for an intermediate layer was applied onto the support by dipping, and the resultant coat was dried for 20 minutes at 170° C. to form an intermediate layer having an average thickness of 30 μm.

Next, a hydroxygallium phthalocyanine crystal (charge generating substance) of a crystal form having peaks at Bragg angles)(2θ±0.2° in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 0.1 part of a compound represented by the formula (3), 5 parts of polyvinyl butyral (trade name: S-LEC BX-1, manufactured by Sekisui Chemical Co., Ltd.), and 250 parts of cyclohexanone were loaded into a sand mill using glass beads each having a diameter of 0.8 mm, and the mixture was subjected to a dispersion treatment for 1.5 hours. Next, 250 parts of ethyl acetate were added to the resultant to prepare a coating liquid for a charge generating layer.

charge generating layer by dipping, and the resultant coat was dried for 40 minutes at 120° C. to form a charge transporting layer having an average thickness of 17 μm.

(CTM-1)

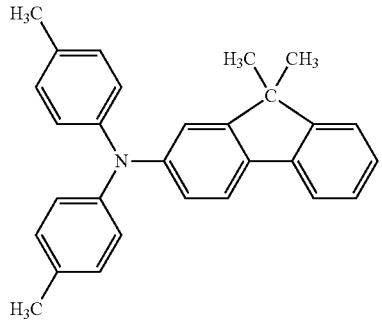

(CTM-2)

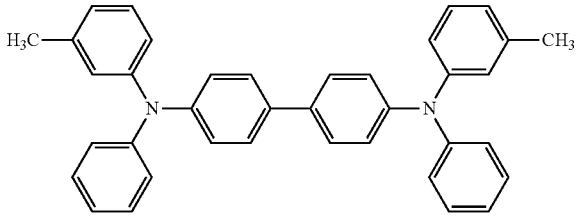

Thus, an electrophotographic photosensitive member of Example 1 was produced.

(3)

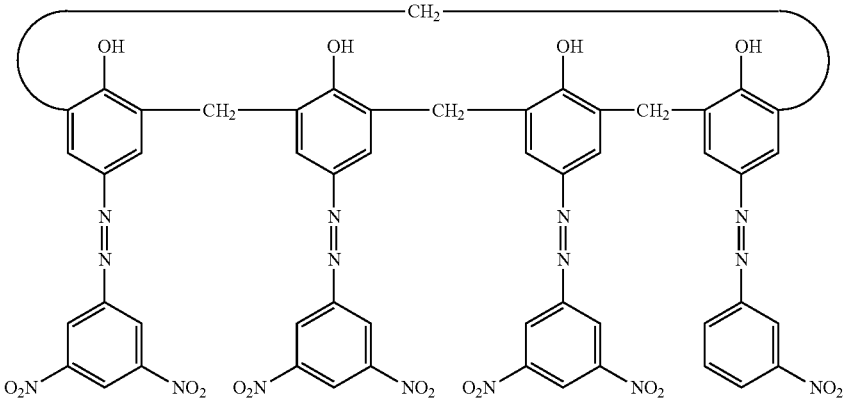

The coating liquid for a charge generating layer was applied onto the intermediate layer by dipping, and the resultant coat was dried for 10 minutes at 100° C. to form a charge generating layer having an average thickness of 0.15 μm.

Next, 4 parts of a triarylamine compound represented by the formula (CTM-1), 4 parts of a benzidine compound represented by the formula (CTM-2), and 10 parts of bisphenol Z-type polycarbonate (trade name: PCZ-400, manufactured by Mitsubishi Gas Chemical Company, Inc.) were dissolved in a mixed solvent containing 40 parts of dimethoxymethane and 60 parts of chlorobenzene to prepare a coating liquid for a charge transporting layer. The coating liquid for a charge transporting layer was applied onto the Examples 2 to 38 and Comparative Examples 1 to 5

Photosensitive members of Examples 2 to 38 and Comparative Examples 1 to 5 were each produced in the same manner as in Example 1 except that in Example 1, the coating liquid for an intermediate layer was changed as shown in Table 4.

(Verification Method for Formation of Complex in Intermediate Layer of Electrophotographic Photosensitive Member)

Verification that a compound represented by the formula (1) and a compound represented by the formula (2) formed a complex with a metal oxide in the intermediate layer of an electrophotographic photosensitive member was performed by the following method.

A film having a width of 1 cm, a height of 3 cm, and a thickness of 0.3 μm was cut out of an intermediate layer in each of the produced electrophotographic photosensitive members. The UV spectrum of the compound represented by the formula (1) or the compound represented by the formula (2), and the UV spectrum of the cut-out film were compared to each other. As a result, the UV spectrum of the cut-out film shifted to longer wavelengths, and hence it was confirmed that the compound represented by the formula (1) and the compound represented by the formula (2) and the metal oxide formed the complex also in the intermediate layer.

(Ghost Evaluation)

An evaluation was performed by mounting each of the produced electrophotographic photosensitive members for evaluations on a reconstructed machine of a laser beam printer (trade name: CP3525dn) manufactured by Hewlett-Packard Japan, Ltd. (Examples 1 to 21 and Comparative Examples 1 and 2), or a reconstructed machine of a laser beam printer (trade name: LBP7700C) manufactured by Canon (Examples 22 to 38 and Comparative Examples 3 to 5). Details about the evaluation are as described below.

The printer was reconstructed so as to operate while pre-exposure was not turned on, and a charging condition and a laser exposure were variable. In addition, the produced electrophotographic photosensitive member was mounted on a process cartridge for a cyan color, and the resultant was attached to the station of the process cartridge for a cyan color.

In each of Examples 1 to 21 and Comparative Examples 1 and 2, the ghost evaluation was performed under the following conditions.

The surface potential of a drum was set under an environment having a temperature of 23° C. and a humidity of 60% RH so that an initial dark portion potential became −600 V and an initial light portion potential became −140 V. Surface potential measurement at the time of the potential setting was performed as described below. The cartridge was reconstructed and a potential probe (trade name: model 6000B-8, manufactured by TREK JAPAN) was mounted at a development position, followed by the measurement of a potential at the central portion of the drum with a surface potentiometer (trade name: model 344, manufactured by TREK JAPAN).

In each of Examples 22 to 38 and Comparative Examples 3 to 5, the ghost evaluation was performed under the following conditions.

The surface potential of the drum was set under an environment having a temperature of 22° C. and a humidity of 35% RH so that an initial dark portion potential became −5,200 V and an initial light portion potential became −100 V. Surface potential measurement at the time of the potential setting was performed as described below. The cartridge was reconstructed and a potential probe (trade name: model 6000B-8, manufactured by TREK JAPAN) was mounted at a development position, followed by the measurement of a potential at the central portion of the drum with a surface potentiometer (trade name: model 344, manufactured by TREK JAPAN).

Figure 3:
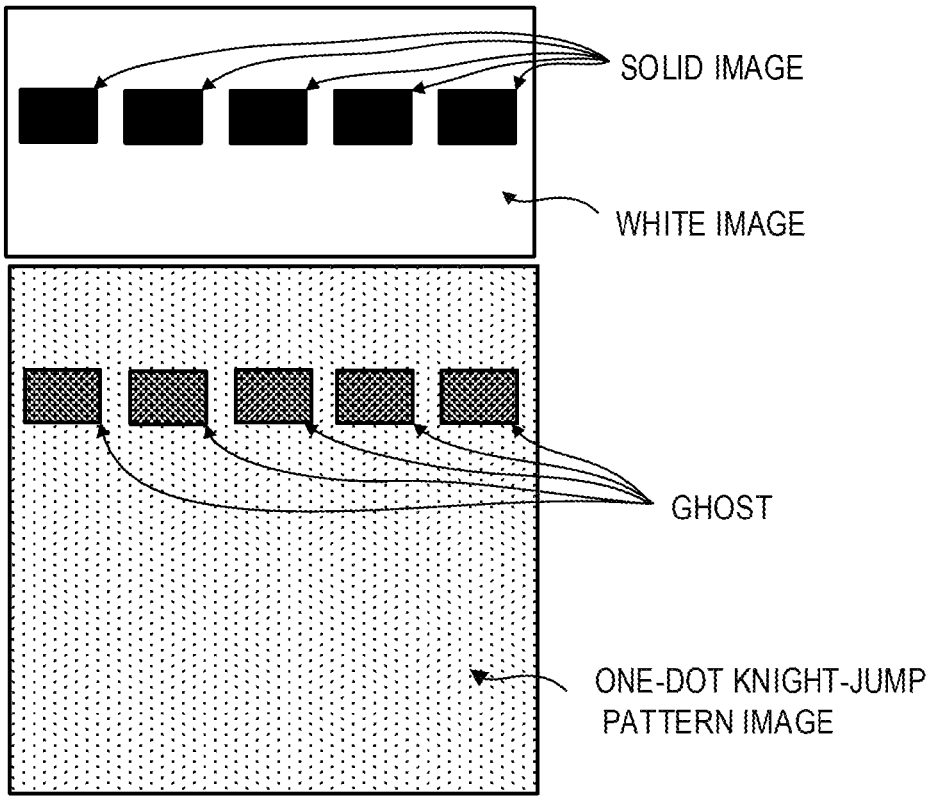
FIG. 3 is a view for describing a printing for a ghost evaluation to be used at the time of a ghost image evaluation.

Such an image for a ghost evaluation as illustrated in FIG. 3 (obtained by outputting a quadrangular solid image in a white ground (white image) in the leading end portion of an image, and then producing a one-dot knight-jump pattern image) was used in a ghost image evaluation. In FIG. 3, a portion represented by the term "GHOST" is a ghost portion where the presence or absence of the appearance of a ghost resulting from the solid image is evaluated. When a ghost appears, the ghost appears in the portion represented by the term "GHOST" in FIG. 3. The ghost evaluation was performed in the following order. A white image was output on a first sheet, and then the image for a ghost evaluation was continuously output on 5 sheets, followed by the performance of the evaluation. The evaluation of the image for a ghost evaluation was performed as described below. A density difference between the image density of the one-dot knight-jump pattern image and the image density of the ghost portion was measured with a spectral densitometer (trade name: X-Rite 504/508, manufactured by X-Rite Inc.) at 5 sites in one image for a ghost evaluation. Then, the average of the values measured at the 5 sites was calculated and defined as a result for the one image. All the 5 images for ghost evaluations were similarly subjected to the measurement, and the average of the measured values was determined. The result is shown in Table 4. A smaller value for the density difference means that the photosensitive member is more excellent in suppression of a ghost. The case where a value for the density difference was 0.05 or more was judged to be at the level at which the suppression of a ghost was not sufficient and hence an effect of the present invention was not obtained. In addition, the case where the value for the density difference is 0.025 or less means that the suppression of a ghost is extremely excellent.

(Sensitivity Evaluation)

An evaluation was performed by mounting each of the produced electrophotoaraphic photosensitive members for evaluations on a reconstructed machine of a laser beam printer (trade name: CP3525dn) manufactured by Hewlett-Packard Japan, Ltd. (Examples 1 to 21 and Comparative Examples 1 and 2), or a reconstructed machine of a laser beam printer (trade name: LBP7700C) manufactured by Canon (Examples 22 to 38 and Comparative Examples 3 to 5), the printers having each been subjected to the same reconstruction as that in the ghost evaluation. Details about the evaluation are as described below.

In each of Examples 1 to 21 and Comparative Examples 1 and 2, the sensitivity evaluation was performed under the following conditions.

The surface potential of the drum was set under an environment having a temperature of 23° C. and a humidity of 50% RH so that an initial dark portion potential became −600 V. Surface potential measurement at the time of the potential setting was performed as described below. The cartridge was reconstructed and a potential probe (trade name: model 6000B-8, manufactured by TREK JAPAN) was mounted at a development position, followed by the measurement of a potential at the central portion of the drum with a surface potentiometer (trade name: model 344, manufactured by TREK JAPAN).

In each of Examples 22 to 38 and Comparative Examples 3 to 5, the sensitivity evaluation was performed under the following conditions.

The surface potential of the drum was set under an environment having a temperature of 22° C. and a humidity of 35% RH so that an initial dark portion potential became −520 V. Surface potential measurement at the time of the potential setting was performed as described below. The cartridge was reconstructed and a potential probe (trade name: model 6000B-8, manufactured by TREK JAPAN) was mounted at a development position, followed by the measurement of a potential at the central portion of the drum with a surface potentiometer (trade name: model 344, manufactured by TREK JAPAN).

The sensitivity evaluation was performed by measuring the surface potential of the drum at the time of the printing of a solid image with an exposure light quantity of 0.35 $\mu J/cm^2$. The results are shown in Table 4. A smaller absolute value of the potential means that the photosensitive member is more excellent in sensitivity.

TABLE 3

| | Metal oxide particles | | | Binder resin 1 | | Binder resin 2 | | Compound | |
|---|---|---|---|---|---|---|---|---|---|
| Coating liquid for intermediate layer | Kind of particles | Particle diameter [nm] | Content [part(s)] | Kind | Content [part(s)] | Kind | Content [part(s)] | Kind | Content [part(s)] |
| Coating liquid 1 | Zinc oxide | 50 | 50 | BM-1 | 1.88 | SUMIDUR BL3175 | 4.74 | Compound 1 | 1 |
| Coating liquid 2 | Zinc oxide | 50 | 50 | BM-1 | 1.88 | SUMIDUR BL3175 | 4.74 | Compound 2 | 1 |
| Coating liquid 3 | Zinc oxide | 50 | 50 | BM-1 | 1.88 | SUMIDUR BL3175 | 4.74 | Compound 3 | 1 |
| Coating liquid 4 | Zinc oxide | 50 | 50 | BM-1 | 1.88 | SUMIDUR BL3175 | 4.74 | Compound 4 | 1 |
| Coating liquid 5 | Zinc oxide | 50 | 50 | BM-1 | 1.88 | SUMIDUR BL3175 | 4.74 | Compound 5 | 1 |
| Coating liquid 6 | Zinc oxide | 50 | 50 | BM-1 | 1.88 | SUMIDUR BL3175 | 4.74 | Compound 6 | 1 |
| Coating liquid 7 | Zinc oxide | 50 | 50 | BM-1 | 1.88 | SUMIDUR BL3175 | 4.74 | Compound 7 | 1 |
| Coating liquid 8 | Zinc oxide | 50 | 50 | BM-1 | 1.88 | SUMIDUR BL3175 | 4.74 | Compound 8 | 1 |
| Coating liquid 9 | Zinc oxide | 50 | 50 | BM-1 | 1.88 | SUMIDUR BL3175 | 4.74 | Compound 9 | 1 |
| Coating liquid 10 | Zinc oxide | 50 | 50 | BM-1 | 1.88 | SUMIDUR BL3175 | 4.74 | Compound 10 | 1 |
| Coating liquid 11 | Zinc oxide | 50 | 50 | BM-1 | 1.88 | SUMIDUR BL3175 | 4.74 | Compound 11 | 1 |
| Coating liquid 12 | Zinc oxide | 50 | 50 | BM-1 | 1.88 | SUMIDUR BL3175 | 4.74 | Compound 12 | 1 |
| Coating liquid 13 | Zinc oxide | 50 | 50 | BM-1 | 1.88 | SUMIDUR BL3175 | 4.74 | Compound 13 | 1 |
| Coating liquid 14 | Zinc oxide | 50 | 50 | BM-1 | 1.88 | SUMIDUR BL3175 | 4.74 | Compound 14 | 1 |
| Coating liquid 15 | Zinc oxide | 50 | 50 | BM-1 | 1.88 | SUMIDUR BL3175 | 4.74 | Compound 10 | 0.025 |
| Coating liquid 16 | Zinc oxide | 50 | 50 | BM-1 | 1.88 | SUMIDUR BL3175 | 4.74 | Compound 10 | 0.25 |
| Coating liquid 17 | Zinc oxide | 50 | 50 | BM-1 | 1.88 | SUMIDUR BL3175 | 4.74 | Compound 10 | 2.5 |
| Coating liquid 18 | Zinc oxide | 50 | 50 | BM-1 | 1.88 | SUMIDUR BL3175 | 4.74 | Compound 10 | 10 |
| Coating liquid 19 | Zinc oxide | 30 | 50 | BM-1 | 1.88 | SUMIDUR BL3175 | 4.74 | Compound 10 | 1 |
| Coating liquid 20 | Titanium oxide | 70 | 13.3 | F-30K | 4.4 | — | — | Compound 10 | 0.3 |
| Coating liquid 21 | Titanium oxide | 130 | 13.3 | F-30K | 4.4 | — | — | Compound 10 | 0.3 |
| Coating liquid 31 | Zinc oxide | 50 | 50 | BM-1 | 1.88 | SUMIDUR BL3175 | 4.74 | Compound 15 | 1 |
| Coating liquid 32 | Zinc oxide | 50 | 50 | BM-1 | 1.88 | SUMIDUR BL3175 | 4.74 | Compound 16 | 1 |
| Coating liquid 33 | Zinc oxide | 50 | 50 | BM-1 | 1.88 | SUMIDUR BL3175 | 4.74 | Compound 17 | 1 |
| Coating liquid 34 | Zinc oxide | 50 | 50 | BM-1 | 1.88 | SUMIDUR BL3175 | 4.74 | Compound 18 | 1 |
| Coating liquid 35 | Zinc oxide | 50 | 50 | BM-1 | 1.88 | SUMIDUR BL3175 | 4.74 | Compound 19 | 1 |
| Coating liquid 36 | Zinc oxide | 50 | 50 | BM-1 | 1.88 | SUMIDUR BL3175 | 4.74 | Compound 20 | 1 |
| Coating liquid 37 | Zinc oxide | 50 | 50 | BM-1 | 1.88 | SUMIDUR BL3175 | 4.74 | Compound 21 | 1 |
| Coating liquid 38 | Zinc oxide | 50 | 50 | BM-1 | 1.88 | SUMIDUR BL3175 | 4.74 | Compound 22 | 1 |
| Coating liquid 39 | Zinc oxide | 50 | 50 | BM-1 | 1.88 | SUMIDUR BL3175 | 4.74 | Compound 23 | 1 |
| Coating liquid 40 | Zinc oxide | 50 | 50 | BM-1 | 1.88 | SUMIDUR BL3175 | 4.74 | Compound 24 | 1 |
| Coating liquid 41 | Zinc oxide | 50 | 50 | BM-1 | 1.88 | SUMIDUR BL3175 | 4.74 | Compound 25 | 1 |
| Coating liquid 42 | Zinc oxide | 50 | 50 | BM-1 | 1.88 | SUMIDUR BL3175 | 4.74 | Compound 26 | 1 |
| Coating liquid 43 | Zinc oxide | 50 | 50 | BM-1 | 1.88 | SUMIDUR BL3175 | 4.74 | Compound 15 | 0.025 |
| Coating liquid 44 | Zinc oxide | 50 | 50 | BM-1 | 1.88 | SUMIDUR BL3175 | 4.74 | Compound 16 | 0.25 |
| Coating liquid 45 | Zinc oxide | 50 | 50 | BM-1 | 1.88 | SUMIDUR BL3175 | 4.74 | Compound 17 | 2.5 |
| Coating liquid 46 | Zinc oxide | 50 | 50 | BM-1 | 1.88 | SUMIDUR BL3175 | 4.74 | Compound 18 | 10 |
| Coating liquid 47 | Titanium oxide | 130 | 13.3 | F-30K | 4.4 | — | — | Compound 19 | 1 |

TABLE 4

| Example No. | Coating liquid | Ghost image evaluation | Sensitivity evaluation |
|---|---|---|---|
| Example 1 | Coating liquid 1 | 0.040 | −129 |
| Example 2 | Coating liquid 2 | 0.046 | −131 |
| Example 3 | Coating liquid 3 | 0.046 | −129 |
| Example 4 | Coating liquid 4 | 0.045 | −135 |
| Example 5 | Coating liquid 5 | 0.047 | −133 |
| Example 6 | Coating liquid 6 | 0.048 | −138 |
| Example 7 | Coating liquid 7 | 0.030 | −116 |
| Example 8 | Coating liquid 8 | 0.028 | −117 |
| Example 9 | Coating liquid 9 | 0.033 | −119 |
| Example 10 | Coating liquid 10 | 0.022 | −105 |
| Example 11 | Coating liquid 11 | 0.023 | −100 |
| Example 12 | Coating liquid 12 | 0.025 | −98 |
| Example 13 | Coating liquid 13 | 0.023 | −103 |
| Example 14 | Coating liquid 14 | 0.020 | −103 |
| Example 15 | Coating liquid 15 | 0.028 | −101 |
| Example 16 | Coating liquid 16 | 0.024 | −100 |
| Example 17 | Coating liquid 17 | 0.020 | −102 |

TABLE 4-continued

| Example No. | Coating liquid | Ghost image evaluation | Sensitivity evaluation |
|---|---|---|---|
| Example 18 | Coating liquid 18 | 0.020 | −134 |
| Example 19 | Coating liquid 19 | 0.023 | −104 |
| Example 20 | Coating liquid 20 | 0.022 | −105 |
| Example 21 | Coating liquid 21 | 0.024 | −99 |
| Example 22 | Coating liquid 31 | 0.021 | −103 |
| Example 23 | Coating liquid 32 | 0.031 | −117 |
| Example 24 | Coating liquid 33 | 0.022 | −101 |
| Example 25 | Coating liquid 34 | 0.021 | −103 |
| Example 26 | Coating liquid 35 | 0.028 | −112 |
| Example 27 | Coating liquid 36 | 0.041 | −128 |
| Example 28 | Coating liquid 37 | 0.032 | −116 |
| Example 29 | Coating liquid 38 | 0.024 | −101 |
| Example 30 | Coating liquid 39 | 0.023 | −99 |
| Example 31 | Coating liquid 40 | 0.02 | −100 |
| Example 32 | Coating liquid 41 | 0.021 | −104 |
| Example 33 | Coating liquid 42 | 0.023 | −101 |
| Example 34 | Coating liquid 43 | 0.027 | −110 |
| Example 35 | Coating liquid 44 | 0.024 | −108 |
| Example 36 | Coating liquid 45 | 0.022 | −105 |
| Example 37 | Coating liquid 46 | 0.021 | −106 |
| Example 38 | Coating liquid 47 | 0.024 | −104 |

TABLE 4-continued

| Example No. | Coating liquid | Ghost image evaluation | Sensitivity evaluation |
|---|---|---|---|
| Comparative Example 1 | Coating liquid 51 | 0.090 | −132 |
| Comparative Example 2 | Coating liquid 52 | 0.072 | −128 |
| Comparative Example 3 | Coating liquid 51 | 0.072 | −128 |
| Comparative Example 4 | Coating liquid 53 | 0.072 | −128 |
| Comparative Example 5 | Coating liquid 54 | 0.072 | −128 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2016-122852, filed Jun. 21, 2016, and Japanese Patent Application No. 2016-122856, filed Jun. 21, 2016, which are hereby incorporated by reference herein in their entirety.

What is claimed is:

1. An electrophotographic photosensitive member, comprising, in this order:

a support;

an intermediate layer containing a metal oxide; and a photosensitive layer, wherein the intermediate layer contains at least one kind of compound X selected from the group consisting of a compound represented by the formula (1) and a compound represented by the formula (2):

(1)

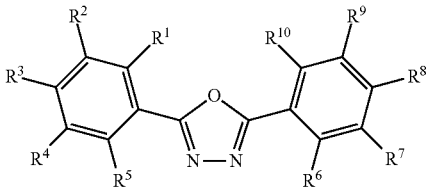

(2)

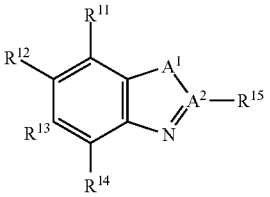

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

2. An electrophotographic photosensitive member according to claim 1, wherein the compound X is a compound represented by the formula (2')

(2')

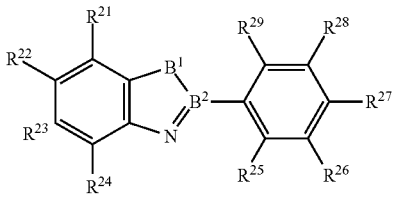

in the formula (2'), $B^1$ represents a carbon atom, a nitrogen atom, or an oxygen atom, when $B^1$ represents a carbon atom, $B^2$ represents a carbon atom or a nitrogen atom, when $B^1$ represents a nitrogen atom, $B^2$ represents a carbon atom, and when $B^1$ represents an oxygen atom, $B^2$ represents a carbon atom or a sulfur atom, $R^{21}$ to $R^{29}$ each independently represent a hydrogen atom, an alkyl group, a hydroxy group, a carboxy group, an amino group, an alkoxy group, and an aryl group, provided that $R^{24}$, $R^{25}$, or $R^{29}$ is limited to a hydroxy group or a carboxy group, and the aryl group may be substituted with an alkyl group, an aryl group, a halogen atom, a hydroxy group, or a carboxy group.

3. An electrophotographic photosensitive member according to claim 1, wherein a content of the compound X in the intermediate layer is 0.05 mass % or more and 20 mass % or less with respect to a content of the metal oxide.

4. An electrophotographic photosensitive member according to claim 1, wherein the metal oxide comprises metal oxide particles each containing at least one kind selected from the group consisting of zinc oxide, titanium oxide, and tin oxide.

5. An electrophotographic photosensitive member according to claim 1, wherein the compound X is a compound represented by the formula (1) in which $R^1$ to $R^{10}$ each independently represent a hydrogen atom, a hydroxy group, or a carboxy group, or a compound represented by the formula (2) in which $R^{11}$ to $R^{15}$ each independently represent a hydrogen atom, a hydroxy group, or a carboxy group.

6. An electrophotographic photosensitive member according to claim 1, wherein the compound X is a compound represented by the formula (1) in which at least one of $R^1$ to $R^{10}$ represents a hydroxy group or a carboxy group.

7. An electrophotographic photosensitive member according to claim 6, wherein the compound X is a compound represented by the formula (1) in which at least one of $R^1$, $R^5$, $R^6$, or $R^{10}$ represents a hydroxy group or a carboxy group.

8. An electrophotographic photosensitive member, comprising, in this order:

a support;

an intermediate layer containing a metal oxide; and a photosensitive layer, wherein the metal oxide forms a complex with at least one kind of compound X selected from the group consisting of a compound represented by the formula (1) and a compound represented by the formula (2):

(1)

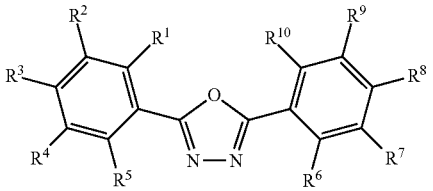

(2)

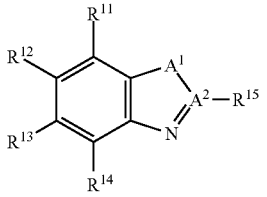

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

9. An electrophotographic photosensitive member according to claim 8, wherein the compound X is a compound represented by the formula (2')

(2')

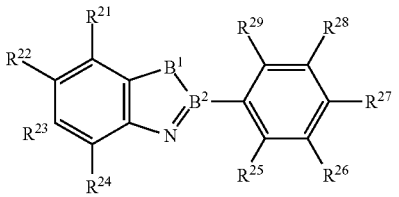

in the formula (2'), $B^1$ represents a carbon atom, a nitrogen atom, or an oxygen atom, when By represents a carbon atom, $B^2$ represents a carbon atom or a nitrogen atom, when $B^1$ represents a nitrogen atom, $B^2$ represents a carbon atom, and when $B^1$ represents an oxygen atom, $B^2$ represents a carbon atom or a sulfur atom, $R^{21}$ to $R^{29}$ each independently represent a hydrogen atom, an alkyl group, a hydroxy group, a carboxy group, an amino group, an alkoxy group, and an aryl group, provided that $R^{24}$, $R^{25}$, or $R^{29}$ is limited to a hydroxy group or a carboxy group, and the aryl group may be substituted with an alkyl group, an aryl group, a halogen atom, a hydroxy group, or a carboxy group.

10. An electrophotographic photosensitive member according to claim 8, wherein a content of the compound X in the intermediate layer is 0.05 mass % or more and 20 mass % or less with respect to a content of the metal oxide.

11. An electrophotographic photosensitive member according to claim 8, wherein the metal oxide comprises metal oxide particles each containing at least one kind selected from the group consisting of zinc oxide, titanium oxide, and tin oxide.

12. An electrophotographic photosensitive member according to claim 8, wherein the compound X is a compound represented by the formula (1) in which $R^1$ to $R^{10}$ each independently represent a hydrogen atom, a hydroxy group, or a carboxy group, or a compound represented by the formula (2) in which $R^{11}$ to $R^{15}$ each independently represent a hydrogen atom, a hydroxy group, or a carboxy group.

13. An electrophotographic photosensitive member according to claim 8, wherein the compound X is a compound represented by the formula (1) in which at least one of $R^1$ to $R^{10}$ represents a hydroxy group or a carboxy group.

14. An electrophotographic photosensitive member according to claim 13, wherein the compound X is a compound represented by the formula (1) in which at least one of $R^1$, $R^5$, $R^6$, or $R^{10}$ represents a hydroxy group or a carboxy group.

15. A method of producing an electrophotographic photosensitive member including, in this order, a support, an intermediate layer containing a metal oxide, and at least one kind of compound X selected from the group consisting of a compound represented by the formula (1) and a compound represented by the formula (2), and a photosensitive layer, the method comprising:

forming a coat of a coating liquid for an intermediate layer containing the metal oxide, and the at least one kind of compound X selected from the group consisting of the compound represented by the formula (1) and the compound represented by the formula (2); and heat-drying the coat to form the intermediate layer:

(1)

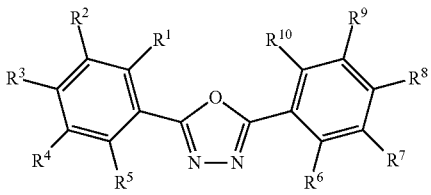

-continued (2)

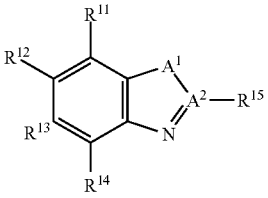

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

16. A process cartridge, comprising:

an electrophotographic photosensitive member including, in this order, a support, an intermediate layer containing a metal oxide, and a photosensitive layer, the intermediate layer containing at least one kind of compound X selected from the group consisting of a compound represented by the formula (1) and a compound represented by the formula (2); and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus:

(1)

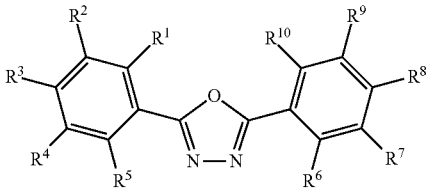

(2)

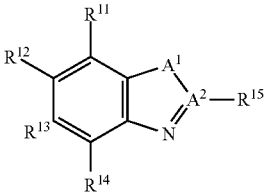

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

17. An electrophotographic apparatus, comprising:

an electrophotographic photosensitive member including, in this order, a support, an intermediate layer containing a metal oxide, and a photosensitive layer, the intermediate layer containing at least one kind of compound X selected from the group consisting of a compound represented by the formula (1) and a compound represented by the formula (2);

a charging unit;

an exposing unit;

a developing unit; and a transferring unit:

(1)

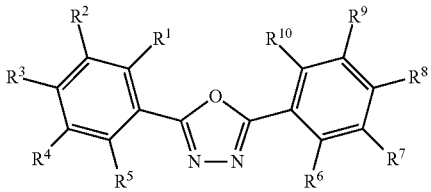

(2)

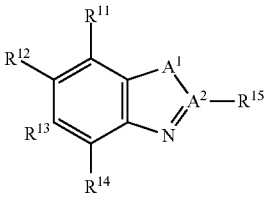

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

18. A process cartridge, comprising:

an electrophotographic photosensitive member including, in this order, a support, an intermediate layer containing a metal oxide, and a photosensitive layer, the metal oxide forming a complex with at least one kind of compound X selected from the group consisting of a compound represented by the formula (1) and a compound represented by the formula (2); and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus:

(1)

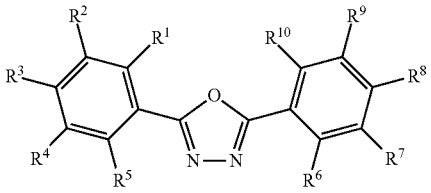

(2)

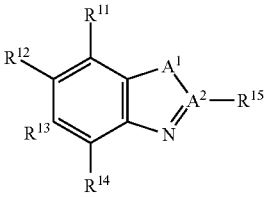

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

19. An electrophotographic apparatus, comprising:

an electrophotographic photosensitive member including, in this order, a support, an intermediate layer containing a metal oxide, and a photosensitive layer, the metal oxide forming a complex with at least one kind of compound X selected from the group consisting of a compound represented by the formula (1) and a compound represented by the formula (2);

a charging unit;

an exposing unit;

a developing unit; and a transferring unit:

(1)

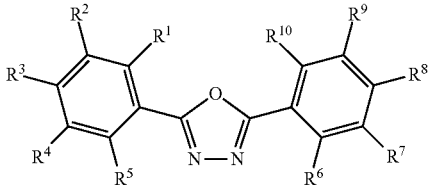

(2)

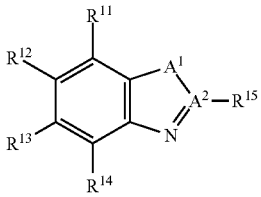

in the formula (1), $R^1$ to $R^{10}$ each independently represent a hydrogen atom, an alkyl group, a hydroxy group, a carboxy group, an amino group, an alkoxy group, and an aryloxy group, one carbon atom in a main chain of the alkyl group may be substituted with O or N, and the alkyl group, the alkoxy group, and the aryloxy group may each be substituted with an alkyl group, an aryl group, a halogen atom, or a carbonyl group;

in the formula (2), $A^1$ represents a carbon atom, a nitrogen atom, or an oxygen atom, when $A^1$ represents a carbon atom, $A^2$ represents a carbon atom or a nitrogen atom, when $A^1$ represents a nitrogen atom, $A^2$ represents a carbon atom, and when $A^1$ represents an oxygen atom, $A^2$ represents a carbon atom or a sulfur atom, $R^{11}$ to $R^{15}$ each independently represent a hydrogen atom, an alkyl group, a hydroxy group, a carboxy group, an amino group, an alkoxy group, and an aryl group, provided that $R^{14}$ is limited to a hydroxy group or a carboxy group, one carbon atom in a main chain of the alkyl group may be substituted with O or N, and the aryl group may be substituted with an alkyl group, an aryl group, a halogen atom, a hydroxy group, or a carboxy group.

* * * * *